United States Patent [19]

Shevach, Yoram

[11] Patent Number: 4,848,662

[45] Date of Patent: Jul. 18, 1989

[54] WATER SPRINKLER

[76] Inventor: Shevach, Yoram, 30 Bandon Ter., Marino, Australia, 5049

[21] Appl. No.: 291,318

[22] Filed: Dec. 28, 1988

Related U.S. Application Data

[63] Continuation of Ser. No. 82,150, Jun. 11, 1987, abandoned.

[30] Foreign Application Priority Data

Sep. 12, 1985 [WO] World Int. Prop. O. ..... PCT/AU85/00225

[51] Int. Cl.[4] ..... B05B 3/04

[52] U.S. Cl. ..... 239/241; 239/237

[58] Field of Search ..... 239/230, 240, 241, 237, 239/238, 243, 246, 587

[56] References Cited

U.S. PATENT DOCUMENTS

| | | | |
|---|---|---|---|
| Re. 25,942 | 12/1965 | Reynolds | 239/241 X |
| 1,074,336 | 9/1913 | Wismar | 239/241 |
| 1,970,126 | 8/1934 | Buckner | 239/240 X |
| 2,009,478 | 7/1935 | Coles et al. | 239/241 X |
| 3,026,044 | 3/1962 | Kennedy | 239/240 X |
| 3,503,554 | 3/1970 | Clifton | 239/587 X |
| 3,580,506 | 5/1971 | Costa | 239/230 |
| 3,580,508 | 5/1971 | Azusa et al. | 239/230 X |
| 3,583,638 | 6/1971 | Eby et al. | 239/230 X |
| 3,677,472 | 7/1972 | Hart et al. | 239/230 |
| 3,715,078 | 2/1973 | Reynolds | 239/230 X |
| 3,921,912 | 11/1975 | Hayes | 239/587 X |
| 3,930,618 | 1/1976 | Lockwood | 239/230 |

FOREIGN PATENT DOCUMENTS

| | | |
|---|---|---|
| 417659 | 7/1968 | Australia . |
| 1517928 | of 0000 | United Kingdom . |

*Primary Examiner*—Andres Kashnikow
*Assistant Examiner*—Patrick N. Burkhart
*Attorney, Agent, or Firm*—Klauber & Jackson

[57] ABSTRACT

A water sprinkler which includes a hollow sprinkler body, a rotor chamber within the body, a freely rotatable stem extending through the body and being in fluid flow communication with the rotor chamber, a sprinkler head on the open end of the stem for rotation therewith, a rotor within the chamber being freely rotatable about the stem and being capable of limited axial sliding movement relative thereto, a water inlet passage communicating with the interior of the stem and also water inlet ports directing water flow into the chamber to cause rotation of the rotor striker means on the rotor co-operable with rotor impact receiving portions on the stem, arranged so that when water flows through the sprinkler, the rotor rotates at high speed and effects relative slower rotation of the stem and sprinkler head.

14 Claims, 3 Drawing Sheets

WATER SPRINKLER

Figure 2:
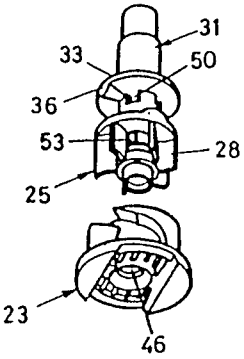

This application is a continuation, of application Ser. No. 082 150, filed June 11, 1987 abandoned.

This invention relates to a water sprinkler of the type which can be used for example in domestic applications but which can also be used in agricultural applications, e.g. for "under tree" irrigation.

The applicant is aware of several water sprinklers of the type which incorporate a water motor comprising an impeller or rotor housed in a sprinkler body and arranged to be rotatably driven by water flowing through the sprinkler body, the rotation of the rotor in turn effecting rotation of a vertical stem which carries at its upper end a sprinkler jet. Examples of sprinklers of this type can be found in U.S. Pat. Nos. 3,930,618, 3,583,638, 3,677,472, U.K. Pat. No. 1,517,928, and Australian Patent Specification No. 417,659.

It is the main object of this invention to provide an improved water sprinkler which is of simple design, is inexpensive to manufacture and which is comprised of few component parts in comparison to prior art devices.

It is a further object of the present invention to provide an improved water sprinkler which is less likely to "clog" up after extended periods of use which will be generally maintenance free.

According to this invention therefore, an improved water sprinkler comprises a generally cylindrical sprinkler body having a central axial bore extending therethrough, the central bore having a large diameter portion which forms a rotor chamber and a small diameter upper bore portion, and water inlet means for receiving water supplied to the sprinkler, an axially extending tubular stem journalled within said central bore of the sprinkler body for free rotational movement, a sprinkler head carried on the upper end of said stem for rotation therewith, a rotor housed within said chamber and having a vertical axis of rotation which coincides with the central longitudinal axis of the sprinkler body, said rotor being freely rotatable about said stem and axially movable to and fro therealong, a main water flow pathway extending centrally through the sprinkler form said inlet means to a water outlet in said sprinkler head, said main pathway being defined at least in part by the bore of said stem, a secondary water flow pathway from said inlet means through the rotor chamber to the interior of said stem, said secondary pathway during operation of the sprinkler, directing water flow into the chamber to cause the rotor to rotate, and striker means on said rotor co-operable with rotor impact receiving portions on said stem, the arrangement being such that when water is flowing through the sprinkler, the rotor rotates at a high speed and causes said striker means to intermittently impact in rapid succession against said impact receiving portions whereby the stem and in turn the sprinkler head are caused to rotate at a relatively lower speed.

The relative rotational and axial sliding movement between the stem and the rotor which occurs during use of the sprinkler and the intermittent impact which results therefrom, serve to significantly reduce the likelihood of any build-up of foreign matter contained in the water, e.g. sand or grit, within the rotor chamber and in turn, the likelihood of the sprinkler operation being impeded.

In a preferred embodiment, the striker means comprises a plurality of upstanding formations on the upper end face of the rotor, the rotor impact receiving portions comprising similarly shaped downwardly projecting formations.

In another preferred embodiment, the sprinkler comprises a removable plug engageable within the lower open end of the body, the plug being provided with a central inlet port for admitting pressure water directly into said stem, and also with tangentially disposed inlet ports or tunnels for directing water into the rotor chamber along the secondary pathway.

In yet another preferred arrangement, the stem projects through a central axial opening formed in the rotor and has its lower end loosely rotatably received in a central cylindrical bore portion formed in the removable plug member, the bore portion in turn communicating with the central inlet port.

In yet another preferred form of this invention, the sprinkler body is formed with an annular radially outstanding flange separating the large diameter and small diameter portions of the sprinkler body, the outer wall of the large diameter body portion being threaded for threadably receiving an internally or externally threaded end of a riser tube which is in turn adapted for connection to a water supply pipe.

In a still further preferred arrangement, the sprinkler head comprises an inner male member formed with a part circular peripheral wall and a central axial bore poriton which frictionallly engages the upper end of the tubular stem whereby the stem and the inner male member rotate together, and a hollow part-spherically shaped female head portion adapted to snap fit over the male member, the head portion being formed with a radially extending through-aperture for receiving a sprinkler jet or nozzle through which water issuing from the upper open end of the stem is, in use, discharged.

Figure 1:
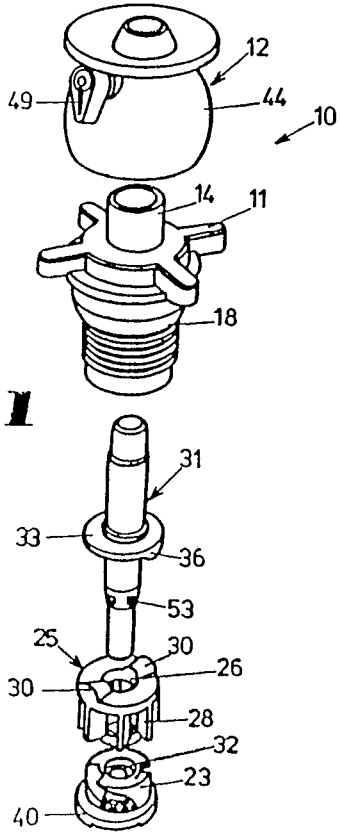
Figure 4:
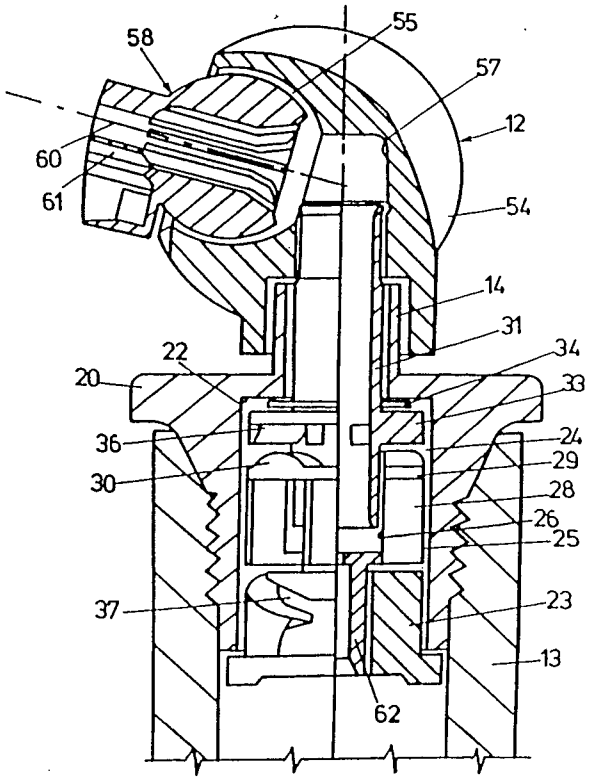
Figure 3:
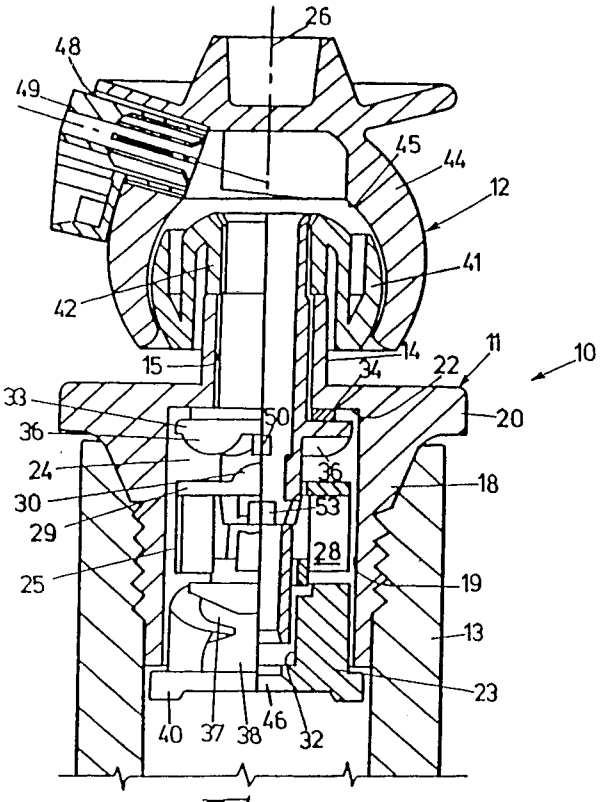
Figure 6:
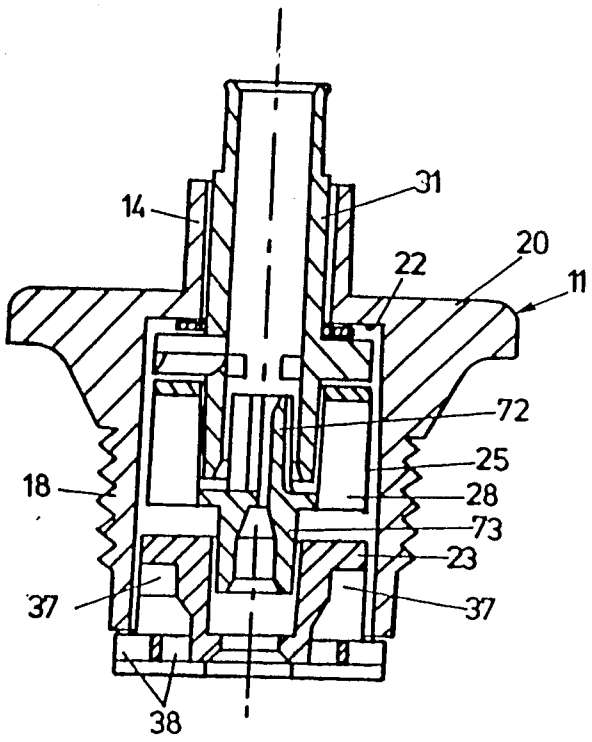
Figure 5:
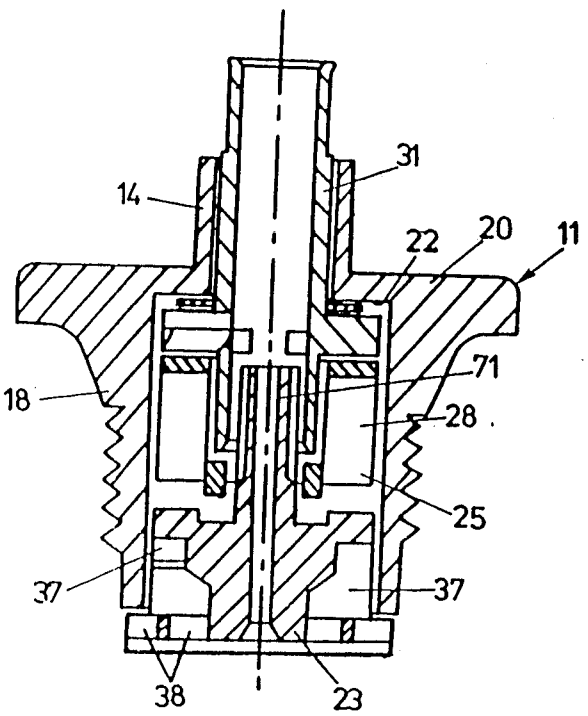

In order to more fully explain the subject invention, several preferred embodiments are described hereunder in some further detail with reference to the accompanying drawings in which:

FIG. 1 is an exploded perspective view of a sprinkler according to a first embodiment, FIG. 2 is a perspective view showing the rotor mounted on the sprinkler stem, FIG. 3 is a part vertical sectional view of the sprinkler shown in FIG. 1, FIG. 4 is a view similar to FIG. 3 of a sprinkler according to a second embodiment, and FIGS. 5 and 6 illustrated different arrangements for the assembly of the sprinkler stem, rotor and cover plug according to further preferred embodiments of the invention.

In the first embodiment of FIGS. 1, 2 and 3, a water sprinkler 10 comprises a generally cylindrical sprinkler body 11 formed of synthetic plastics materials, a rotary sprinkler head 12 at the upper end of the body 11, the lower end of the body being adapted for connection to a riser tube 13 extending upwardly from a sprinkler base (not shown), and being connectable to a water supply pipe (not shown).

The sprinkler body 11 comprises a small diameter body portion 14, the inner surface of which defines a small diameter bore portion 15, and a large diameter body portion 18, the inner surface of which defines a large diameter bore portion 19. The body portion 18 has an external thread for threadable engagement with the riser tube 13. The body portion 14 terminates at its lower end in an annular radially outstanding flange 20.

The small diameter bore portion 15 extends from the open upper end of the body 11 and terminates at its lower end in a radially out-turned horizontal shoulder 22 which in turn merges with the large diameter bore portion 19, which extends to the open lower end of the body 11.

The open lower end of the large diameter body portion 18 is closed by means of a plug or closure member 23 which is removably in a spigot/socket manner in the large diameter bore portion 19.

The large diameter bore portion 19 defines a chamber 24 in which is housed a rotor or impeller 25 which is arranged to rotate about a vertical axis which coincides with the central vertical axis 26 of the sprinkler body 11. The rotor 25 has a central through-opening 26 and a plurality of radially porjecting circumferentially spaced blades or vanes 28 against which water flowing into the rotor chamber 24 impinges to rotate same. The upper end of the rotor 25 is formed with an annular ring 29 which is provided with integral upstanding convexly curved striker portions 30, in this embodiment there being two such striker portions 30 diametrically opposed. In this embodiment, the rotor 25 is of lightweight plastics material.

An elongate tubular stem 31 is rotatably housed within the sprinkler body 11 and extends through the small diameter bore portion 15 and also through the rotor chamber 24 for most of its length, the rotor 25 being arranged to freely rotate about the stem and being slidable to and fro therealong within the confines of the chamber 24. The upper end of the stem 31 projects outwardly from the open upper end of the sprinkler body 11 in which it is journalled for rotation, and carries the sprinkler head 12 whilst the lower end of the stem 31 is journalled in a central bore 32 formed in the plug 23. Intermediate the open ends of the stem 31 is a radially outstanding annular flange 33 which has a diameter larger than the diameter of the small diameter bore portion 15 of the sprinkler body 11 but less than the large diameter bore portion 19 of the sprinkler body 11. The upper surface of the annular flange 33 abuts against the shoulder 22 in the sprinkler body 11, and, if necessary, an annular washer 34 is interposed between the shoulder 22 and the flange 33 to avoid leakage of water. The underside of the annular flange 33 is formed to have a pair of diametrically opposed downwardly projecting convexly curved formations 36 of similar shape to the striker portions 30, the formations 36 constituting impact receiving portions on the stem 31, and which in use, co-operate with the striker portions 30 on the rotor 25 to effect incremental rotational advance of the stem 31, the impact between the striker portions 30 on the rotating rotor 25 and the formations 36 on the stem 31 causing such incremental advance. It will of course be appreciated that the impacts occur in rapid succession with the result that the stem 31 rotates continuously but at a reduced rotational speed relative to the high rotational speed of the rotor 25.

A pair of tangentially disposed spiral inlet ports or tunnels 37 are formed in the plug or cover member 23, each tunnel at its upper end communicating with the rotor chamber 24, the lower end thereof comprising an enlarged mouth portion 38 which communicates with the interior of the riser tube, via mesh-like openings in the base wall 40 of the plug 23, the mesh-like openings serving as a filter. The tunnels 37 are designed so that water enters the chamber 24 in an approximate tangential direction near the tips of the rotor blades 28. In this way, rotating or swirling mass or stream of water is created within the chamber 24 and produces a torque to cause rotation of the rotor 25.

The sprinkler head 12 is carried on the upper end of the stem 31 for rotation therewith and comprises a male ball joint member 41 formed with a central tubular sleeve portion 42 which engages with a push-fit or snap-fit over the projecting open upper end of the tubular stem 31, and a female ball joint member 44, which "snap fits" over the male member. The female member 44 comprises an approxiametly C-shaped socket housing 45 and an approximately radially through-opening 48 through its wall, a sprinkler jet or nozzle 49 being press-fitted within the opening 48. The "ball-joint" arrangement of the sprinkler head 12 enables the trajectory angle of the water stream issuing from the jet 49 to be readily varied, as well as the speed of rotation of the head (by adjusting the angle of inclination of the member 44).

The operation of the sprinkler is as follows: The water supply is turned on and water flows upwards through the riser tube 13 into the inlet of the plug 23, whereupon it is divided into two separate streams, one of which follows a pathway which extends from the inlet port 46 upwards through the stem 31 and into the head 12, the other of which follows a pathway from the inlet ports 37 in the plug 23 into the chamber 24, the water flow into and through the chamber causing the rotor to rotate and to move it upwardly to impact against the stem flange 33, water in the chamber in turn passing into the stem 31 via the apertures 50, 53 in the stem 31. The intermittent impact collisions between the rotor striker portions 30 and the formations 36 on the stem flange 33 produce the rotation of the tubular stem 31 and the sprinkler head 12 carried thereon at a lower speed than that of the rotor 25. The impact between the rotor and the stem flange will momentarily cause the rotor to recoil downwardly away from the stem flange, such impact and recoil movement occurring in rapid succession. Water flowing upwardly through the stem 31 is discharged through the jet or nozzle 49 of the sprinkler head 12, the rotary movement of the head 12 being effective to water a circular area. It will be realised that the speed of the rotor and its torque can be varied by varying the arrangement of the apertures and their dimensions, and by utilising plugs having axial bores and tunnels of different cross-section dimensions, this in turn determining the volume of water which passed directly through the stem bore and that which flows through the tunnels.

As shown in FIGS. 1–3, the stem 31 is provided with an upper row of circumferentially spaced eduction apertures 50 adjacent the flange 33 and a lower row of circumferentially spaced apertures 53, the apertures 50, 53 placing the rotor chamber 24 into fluid flow communication with the stem bore. When water is flowing through the sprinkler 10 along the two pathways, eduction of water from chamber 24 through the sets of apertures 50, 53 is effective to create a resultant "suction" force which acts to pull the rotor 25 upwards towards the stem flange 33, whereby the rotor striker formations 30 make more effective impact against the formations 36 on the stem flange 33. In this embodiment, the co-acting shoulder formations 30 36 are designed to make point or line contact upon impact, this being effective to minimise slipping, wear and contact time. Impact also deflects the rotor 25 downwardly, so that it may again recover its rotation, and move upwardly by the suction force.

As shown in the embodiments of FIGS. 4, 5 and 6, the lower row of apertures is eliminated, and the stem 31 terminated short of the plug 23 to thereby allow water within the chamber 24 to flow through the rotor vanes 28 into the open lower end of the stem 31.

In the embodiment illustrated in FIG. 4, the sprinkler head 12 comprises a substantially ball-shaped body 54 formed with a ball socket housing 55 the inner end of which communicates with a central passageway 57 communicating with the open upper end of the tubular stem 31. The body 54 is located on the stem 31 a simple push-fit (or snap-fit) connection and thus rotates therewith. The radially outer end of the ball socket housing 55 opens in a direction which extends upwardly and radially outwards of the central vertical axis of the sprinkler body 11. A cup-shaped sprinkler nozzle or jet 58 is snap-fitted within the ball socket housing 55 so as to form a "ball-joint" connection, and is provided with a main water discharge passageway 60 concentric with the inlet opening of the nozzle and which extends axially therethrough and a separate secondary discharge passageway 61 offset therefrom, which serves to improve the "spread" of the discharged streams. The trajectory angle of the water stream issuing from the jet 58 can be readily altered by simply rotating the cup-shaped nozzle or jet 58 within its housing 55. In the FIG. 4 embodiment, the rotor 25 comprises a short depending hollow spindle portion 62 which is loosely received within the plug bore, whilst the lower end of the stem 31 is loosely received within a central opening of the rotor and about which the rotor rotates in use.

With reference to FIGS. 5 and 6 of the drawings, these embodiments illustrate alternative arrangements for the assembly of the stem 31, rotor 25 and plug 23 within their sprinkler body 11. In FIG. 5, the plug 23 is formed with an upwardly projecting hollow spigot portion 71 which projects upwardly through the centre of the rotor 25 and is loosely received within the open lower end of the stem 31, whilst in FIG. 6, the rotor 25 is provided with an upstanding axial spigot portion 72 loosely received in the lower end of the stem 31 and a depending spigot portion 73 which is loosely received in the central bore of the plug 23.

In yet a further embodiment of this invention, (not illustrated), the plug member is formed as a cylindrical body which has its lower end secured within the open upper end of a plastics membrane sleeve, the base of the sleeve being perforated so as to constitute a filter for filtering the water prior to its entering the sprinkler body. The outer wall surface of the plug is formed with a pair of open axial grooves which co-operate with the wall of the membrane sleeve to form a pressure regulator unit, the regulator being effective to produce a constant volume of water flowing through the sprinkler body regardless of water pressure.

In all embodiments, the body portion 18 will be seen to be small in diameter, so that its threaded portion can threadably engage a standard pipe fitting. This is possible, partly because use in made of suction to draw the rotor upwardly as water is educted from the chamber 24 through the apertures 50, 53, by flow of the stream of water through the bore of the tubular stem 31. Since the upper end of the rotor 25 is an annular ring, there is negligible impedance thereby to such flow.

A brief consideration of the above embodiments will indicate that the invention provides for a "miniature" rotary water sprinkler of very simple construction which is inexpensive, easy to manufacture and can be readily assembled and dis-assembled, and one which should require only limited maintenance.

I claim:

1. A water sprinkler comprising:

a generally cylindrical sprinkler body of unitary construction having a central axial bore extending therethrough, the central bore having a large diameter lower bore portion defined by a wall which forms a rotor chamber with an open lower end and a small diameter upper bore portion, a removable closure plug with engaging within and projecting into the open lower end of said rotor chamber, said closure plug being provided with a central water inlet opening extending axially therethrough, a freely rotatable tubular stem extending axially through said sprinkler body and having its lower end journalled for rotation within the central opening of said closure plug, and its upper end journalled for rotation in said small diameter upper bore portion of the sprinkler body, the bore of the stem defining a water flow passage upwardly through which water flows when the sprinkler is in use, aperture means in the wall of said stem for placing the stem interior into water flow communication with said rotor chamber, a sprinkler head carried on the upper end of said stem for rotation therewith, a rotor housed within said chamber and having a vertical axis of rotation which coincides with the central longitudinal axis of said sprinkler body, said rotor being freely rotatable about said stem and axially slidable to and fro there along, said rotor having an annular bearing surface at each of its upper and lower axial ends and through which extends said tubular stem, and a series of radially projecting vanes spaced angularly around said vertical axis of rotation of the rotor and extending axially between said bearing surfaces, arranged so that, in use, water entering the chamber can flow between the vanes and into the stem interior through said aperture means being located between the upper and lower axial ends of the rotor, said closure plug also being provided with approximately tangentially disposed sprial inlet port or tunnel means opening into said chamber in proximity to the rotor chamber bore wall for directing the flow of water so as to impinge against the rotor vanes and cause said rotor to rotate, and striker means on said rotor co-operable with rotor impact receiving portions on said stem, the arrangement being such that when the sprinkler is in use and water is flowing therethrough, the rotor rotates at a high speed and causes said striker means to intermittently impact in rapid succession against said impact receiving portions whereby the stem and in turn the sprinkler head are caused to rotate at a relatively low speed.

2. A water sprinkler according to claim 1 wherein said stricker means comprises a plurality of arcuate shoulder formations on the upper end face of the rotor, the rotor impact receiving portions comprising similarly shaped downwardly projecting arcuate shoulder formations.

3. A water sprinkler according to claim 2 wherein said formations are arranged in diametrically opposed pairs.

4. A water sprinkler according to claim 1 wherein said stem comprises a radially outstanding circular flange located approximately midway between its ends, the diameter of the stem being slightly less than the diameter of the large diameter bore portion of the sprinkler body, the underside of said flange being provided with said rotor impact receiving portions, the upper face of said flange being arranged to abut against a shoulder formed in the central bore of the body between the small and large diameter bore portions.

5. A water sprinkler according to claim 1 wherein said sprinkler head comprises a female "ball" joint member defining a cup shaped housing, and a male ball joint member received within said housing, said members being swivellably adjustable relative to one another, such an arrangement enabling the trajectory angle of the water stream issuing from the sprinkler head to be readily varied.

6. A water sprinkler according to claim 5 wherein said male ball-joint member is secured to the upper end of said stem, and said female ball joint member is adapted to snap fit over said male member, whereby the female member can be swivellably adjusted relative to said male member.

7. A water sprinkler according to claim 1 wherein said sprinkler body, said stem, said rotor and said plug are all formed of a moulded plastics material.

8. A water sprinkler according to claim 1 wherein said sprinkler head comprises a nozzle having an inlet opening at its radially inner end, a main water discharge passage concentric with the inlet opening, and a separate secondary discharge passage offset therefrom.

9. A water sprinkler according to claim 1 wherein said body has an externally threaded portion for threadably engaging a water supply pipe or tube, the external diameter of the threaded portion being greater than the diameter of the rotor chamber.

10. A water sprinkler according to claim 1 wherein the stem is provided with a plurality of further apertures extending through its wall and opening into said rotor chamber, said apertures being located adjacent the underside of said flange, whereby in operation of the sprinkler, a sub-pressure is created in the vicinity of the apertures which produces a short-distance suction force between the upper face of the rotor and the underside of the flange, the suction force assisting to draw or pull the rotor in the direction of impact with the stem flange.

11. A water sprinkler according to claim 2 wherein the shoulder formations are constructed so that, in operation of the sprinkler, impulse collisions occur between the rotor and the stem.

12. A water sprinkler according to claim 11 wherein said shoulder formations are shaped so that, upon impact, the contact therebetween is along a mutual radial collision line or collision point, and also so that the collision angle therebetween produces a resultant momentum which acts on the rotor causing it to recoil with minimum slippage and friction away from the shoulder formations on the stem.

13. A water sprinkler according to claim 5 wherein said male ball-joint member comprises a nozzle or jet from which water issues during use of the sprinkler.

14. A water sprinkler according to claim 1 wherein said inlet port or tunnel mean is defined in part by the cylindrical wall of said rotor chamber.

* * * * *